US008628089B2

(12) United States Patent
Knell et al.

(10) Patent No.: US 8,628,089 B2
(45) Date of Patent: Jan. 14, 2014

(54) JIGSAW PUZZLE HAVING ONE OR MORE PUZZLE PIECES THAT CAN BE BENT

(75) Inventors: Florian Knell, Eberhardzell-Muehlhausen (DE); Joerg R. Bauer, Weingarten (DE)

(73) Assignee: Ravensburger Spieleverlag GmbH, Ravensburg (DE)

( * ) Notice: Subject to any disclaimer, the term of this patent is extended or adjusted under 35 U.S.C. 154(b) by 39 days.

(21) Appl. No.: 13/513,591

(22) PCT Filed: Dec. 3, 2010

(86) PCT No.: PCT/EP2010/007360
§ 371 (c)(1),
(2), (4) Date: Jul. 19, 2012

(87) PCT Pub. No.: WO2011/066988
PCT Pub. Date: Jun. 9, 2011

(65) Prior Publication Data

US 2013/0134676 A1 May 30, 2013

(30) Foreign Application Priority Data

Dec. 3, 2009 (DE) ..... 10 2009 056 766

(51) Int. Cl.
*A63F 9/12* (2006.01)

(52) U.S. Cl.
USPC ..... 273/157 R

(58) Field of Classification Search
USPC ..... 273/157 R, 153 R; 446/109, 110, 115
See application file for complete search history.

(56) References Cited

U.S. PATENT DOCUMENTS

| | | | | | |
|---|---|---|---|---|---|
| 3,485,496 | A | * | 12/1969 | Brunton | 273/157 R |
| 3,940,142 | A | * | 2/1976 | Hinz et al. | 446/109 |
| 4,357,744 | A | | 11/1982 | McKenzie et al. | |
| 4,824,112 | A | * | 4/1989 | Roy | 273/157 R |
| 4,874,341 | A | * | 10/1989 | Ziegler | 446/109 |
| 5,251,900 | A | * | 10/1993 | Gallant | 273/157 R |
| 5,351,957 | A | * | 10/1994 | Scott | 273/157 R |
| 5,860,650 | A | * | 1/1999 | Scobbie et al. | 273/157 R |
| 6,086,067 | A | * | 7/2000 | Benoit et al. | 273/157 R |

FOREIGN PATENT DOCUMENTS

| | | |
|---|---|---|
| DE | 694 19 429 T2 | 3/2000 |
| DE | 695 16 137 T2 | 8/2000 |
| DE | 10 2009 056 286.9 A1 | 6/2011 |
| WO | 2008/017201 A1 | 2/2008 |

OTHER PUBLICATIONS

International Search Report for corresponding Appln. No. PCT/EP2010/007360 mailed Mar. 18, 2011.

* cited by examiner

*Primary Examiner* — Steven Wong
(74) *Attorney, Agent, or Firm* — Carter, DeLuca, Farrell & Schmidt LLP

(57) ABSTRACT

The disclosure relates to a jigsaw puzzle having at least one puzzle piece that can be bent along at least one predefined bending line, and that has an upper side and a lower side and a puzzle piece thickness extending between the upper side and the lower side which is reduced from an inner side of a bend along each bending line. In order to neutralise the resilient restoring force that acts in the bent state, on each side of each bending line there is a fixing device which releasably fixes a desired bending angle, each fixing device having at least one recess into which a corresponding protrusion engages in a clamping and/or latching manner when the puzzle piece is bent.

11 Claims, 7 Drawing Sheets

JIGSAW PUZZLE HAVING ONE OR MORE PUZZLE PIECES THAT CAN BE BENT

The invention relates to a jigsaw puzzle which has at least one puzzle piece that can be bent along at least one predefined bending line and that has an upper side and a lower side and a puzzle piece thickness that extends between the upper side and the lower side and is reduced from an inner side of the bend along the bending line or each bending line. A jigsaw puzzle of this kind is known from the Spanish Patent Application bearing the publication number 2 133 232.

In conventional jigsaw puzzles having bendable puzzle pieces for producing three-dimensional objects assembled from puzzle pieces, the problem arises that the flat faces of the object arch, a fact which leads to an unattractive and unrealistic appearance on the part of the object when the puzzle has been completed. In addition, the last pieces, in particular, of such an object can be fitted only unsatisfactorily, that is to say, the last puzzle pieces, in particular, can be inserted only with difficulty in the object when the puzzle has been almost completed.

The underlying object of the invention is to provide an improved jigsaw puzzle with bendable puzzle pieces, in which the aforesaid problems no longer occur.

Adopting the jigsaw puzzle initially mentioned as the starting point, this object is achieved, according to the invention, through the fact that, on either side of each bending line, there is a fixing device which releasably fixes a desired bending angle, each fixing device having at least one recess in which a corresponding protrusion engages in a clamping and/or latching manner when the puzzle piece is bent. In the context of the present invention, it has been recognised that the arching faces of three-dimensional jigsaw puzzles and the aforesaid difficulty in doing them are brought about by restoring forces which, in the bent state, each bendable puzzle piece transfers in a resilient manner to adjacent puzzle pieces which are connected to it. These restoring forces lead to distortions in flat sections of the jigsaw puzzle adjacent to the bending points, which distortions occur in dependence upon the material of the bendable puzzle piece, the temperature, the bending angle, the geometry of the bendable puzzle piece, etc., and therefore ultimately in a completely undefined manner. By means of the solution according to the invention, these restoring forces are neutralised and their transmission to adjacent puzzle pieces prevented, so that the said forces can no longer have a detrimental effect.

According to the invention, the fixing device has at least one recess in which a corresponding protrusion engages when the puzzle piece is bent over. For the purpose of fixing a desired bending angle, the protrusion can engage in the recess in a clamping and/or latching manner. For example, the protrusion may have a slight oversize compared to the recess, so that it is in engagement with said recess in a clamping manner in any bending position. Alternatively, the protrusion may be conical in shape, so that it is engagement with the recess in a clamping manner only from a specific bending angle onwards. Finally, the protrusion may enter into engagement with the recess in a latching manner when a desired bending angle is reached, in order to fix the said bending angle in a releasable manner. For example, there may be constructed, on at least one face of the protrusion and/or of the recess, which face extends at least substantially in the direction of the bending line cross-section, a latching protrusion which interacts, when the puzzle piece is in a predetermined bending position, in an inter-latching manner with a corresponding latching depression in an opposing face of the recess or of the protrusion respectively. In order to ensure the latching function, it is merely necessary to provide on that face, for example of the protrusion, which extends in the direction of the bending line cross-section, a latching protrusion which engages in a corresponding latching depression in the opposing face of the recess. However, it is also possible to construct latching protrusions on a number of faces of the protrusion that extend in the direction of the bending line cross-section and/or both on faces of the protrusion and of the recess that extend in the direction of the bending line cross-section, which latching protrusions are capable of engaging in latching depressions in the opposing face that are respectively associated. The at least one recess is preferably arranged in a side wall of a groove which is formed along a bending line of a bendable puzzle piece by the puzzle piece thickness which is reduced at that point, and the corresponding protrusion is arranged in the opposing side wall of the groove.

The fixing device may also be designed in such a way that the engagement between the elements that bring about the releasable fixing takes place in both a clamping and a latching manner. For example a latching protrusion formed on a protrusion may initially come into clamping engagement with the recess in which the protrusion engages when the puzzle piece is bent over, and may come into engagement in an inter-latching manner with an associated latching depression when bending-over continues and a desired bending angle is reached. Other forms of embodiment of a clamping and latching engagement of the fixing device are possible.

The protrusion which engages in the corresponding recess in the opposing side wall of the groove when a bendable puzzle piece is bent over may be constructed in various ways. In one preferred form of embodiment of the jigsaw puzzle according to the invention, the protrusion is formed by a section of the particular side wall of the groove that does not project above the puzzle piece thickness. Such a form of embodiment makes it possible to accommodate the fixing device within the compass of the regular material thickness of the puzzle piece, i.e. there are no elements of the fixing device that project beyond the thickness of the puzzle piece; on the contrary, the fixing device is integrated, with the surfaces flush, into the puzzle piece on either side of the groove that extends along a bending line.

Alternatively, it is also possible for the protrusion, or each protrusion, on the fixing device to project above the puzzle piece thickness, for example if the material thickness of the puzzle pieces is too small to provide a fixing device within the limits of said thickness.

Although one protrusion and one recess cooperating therewith, which protrusion and recess are constructed in the two mutually opposing side walls of the groove, are basically sufficient as the fixing device per bending line of a bendable puzzle piece, it is preferable if a number of protrusions, and of recesses corresponding with the latter, are arranged in a manner distributed over the length of a groove in order to even out, across the puzzle piece, the neutralising of the restoring force that still remains. Because of the greater area of engagement which is then available, the individual elements of the fixing device may be of smaller design without the clamping force that can be achieved overall suffering as a result. The protrusions themselves can have any shape that permits clamping and/or latching in a corresponding recess. For example, the protrusions may be block-shaped, pin-shaped or lamella-like. On the protrusions, there may be latching elements which engage, when bending-over occurs, in corresponding latching depressions which are provided on opposing faces of the fixing device.

Jigsaw puzzles according to the invention consist of a large number of puzzle pieces of which at least one, but as a rule a number and even, under certain circumstances, all of them, can be bent over along at least one predefined bending line. The bendable puzzle piece or pieces may also have a number of predefined bending lines which extend, for example, parallel to one another and have their inner sides of the bend all arranged on the same side of the puzzle piece. Alternatively, the inner sides of the bend of the various bending lines may be arranged on opposite sides of the puzzle piece, for example on one and the other side of said puzzle piece alternately, in order to permit a puzzle piece which is bent in a zigzag shape. It is also possible for bending lines belonging to a bendable puzzle piece to extend at right angles to one another and to have, for example, a common end point of the bending lines. If the inner sides of the bend of two such bending lines that extend at right angles to one another are arranged on the same side of the bendable puzzle piece, it is possible to form, for example, the corner of a cube with a bendable puzzle piece of this kind. Naturally, bending lines of a bendable puzzle piece may also extend obliquely to one another in order to permit, for example, the formation of the point of a pyramid or similar pieces.

Because, according to the invention, the puzzle piece thickness of a bendable puzzle piece is reduced only from an inner side of the bend, the outer side (visible side) of the puzzle piece has no visible interruption when in the bent-over state, but forms a perfect edge between the bent-over partial faces of the visible side of the puzzle piece.

A groove, which is formed along each bending line of a bendable puzzle piece by the puzzle piece thickness which is reduced at that point, may have various cross-sectional shapes; however its bottom region is preferably always designed in such a way that a bottom region of the groove, above which the side walls of said groove extend, defines, when viewed in cross-section, a free space which remains at least partially preserved, even when the puzzle piece is in the bent-over state. This free space in the lowest region of each groove prevents the squeezing-together of material, which would bring about an elastic restoring force acting in the direction of opening, from occurring at the deepest base of the groove when the puzzle piece is bent over. On the contrary, material which may possibly be displaced at the base of the groove in the course of the bending-over operation is able to move out of the way into the free space. The tendency of a bendable puzzle piece according to the invention to open again after being bent over is therefore significantly reduced, compared to conventional bendable puzzle pieces. In forms of embodiment of the jigsaw puzzle according to the invention that have the free space in the bottom region of each groove, therefore, the restoring forces of each bendable puzzle piece which act like an elastic spring are much smaller than has hitherto been usual, so that the fixing device has fewer forces to neutralise and can therefore be of smaller and less conspicuous dimensions.

The bottom region of the groove, or of each groove, is preferably provided with a rounded-off cross-section. For example, the groove may have an approximately V-shaped cross-section, in which the point of the V is cut off and replaced by a segment of a circle, for example by a semicircle. The groove may also have an upwardly open, rectangular or square cross-section, in which the corners belonging to the bottom region of the groove are of rounded-off design. The groove may also have a U-shaped cross-section. Other cross-sectional shapes for the groove are possible; for example, the side walls of said groove that extend above its bottom region do not have to be flat, but may be designed so as to be arched in cross-section.

In order to keep the restoring forces mentioned low, the side walls of the groove that extend above its bottom region are shaped in such a way that they touch each other, at the earliest, when a desired bending angle is reached. The side walls of the groove that face towards one another are preferably inclined in such a way that they still do not touch each other when the desired bending angle is reached and, in a particularly preferred manner, the said sidewalls are inclined in relation to one another in such a way that they come into contact with one another shortly after the desired bending angle has been exceeded. In the case of the last-mentioned configuration, the side walls of the groove function as a mechanical stop which comes into action shortly after the desired bending angle has been exceeded, without it being possible, at the desired bending angle itself, for any restoring forces to be transmitted by side walls of the groove that touch each another.

The restoring forces that act when a puzzle piece is in the bent-over state, and that may optionally be minimised, are neutralised in their action by the fixing device which is present according to the invention and which fixes a desired bending angle in a releasable manner. Under these circumstances, the fixing device may be designed in such a way that it is capable of releasably fixing a large number of different bending angles, but it may also be constructed in such a way that it releasably fixes only a specific desired bending angle. The fixing device is preferably provided only in regions above the bottom region of each groove that defines the free space.

Jigsaw puzzles according to the invention permit the production of three-dimensional structures with corners, edges and points, under which circumstances flat faces adjoining corners, edges or points display no arching of any kind because of the bendable puzzle pieces which are devoid of restoring action, and the individual puzzle pieces can be inserted satisfactorily in the combination of puzzle pieces that already exists. Puzzle pieces according to the invention also permit the formation of statically load-bearing angle profiles, by virtue of the fact that, in the state in which they are folded over and connected to one another, a plurality of bendable puzzle pieces forms one angle profile in each case. A number of such angle profiles may serve, for example, as a load-bearing structure for a building or the like made of puzzle pieces.

If bendable puzzle pieces that have been described in the context of the present invention are shaped, at their peripheral edges, prolongations and recesses, in the manner which is set out in German Patent Application No. 10 2009 056 286.9 bearing the title "Self-stabilising jigsaw puzzle" by the same Applicant, it is possible to assemble angle profiles which are assembled from puzzle pieces and are sturdy yet can be undone again, and which can assume a load-bearing function, even in the horizontal direction, within the three-dimensional object which is to be produced from a puzzle. In this way, three-dimensional objects made of puzzle pieces are obtained which have a high static load-bearing capacity. In order to further improve the sturdiness of a three-dimensional puzzle, the puzzle pieces that form flat faces may also be constructed in accordance with the Patent Application mentioned, No. 10 2009 056 286.9, and may thereby be self-stabilising.

The individual puzzle pieces of a jigsaw puzzle according to the invention preferably consist of plastic; however, the present invention is not confined to puzzle pieces made of plastic. For example, the puzzle pieces may be manufactured from a cardboard material. The puzzle pieces may also be of multi-layer composition and the individual layers may consist of different materials. For example, each puzzle piece may have a core made of cardboard material which is coated on the upper side and/or lower side with plastic, for instance by means of a plastic film. Other combinations of materials are likewise contemplated.

If the individual puzzle pieces of a jigsaw puzzle according to the invention consist of plastic, the said pieces are preferably manufactured by plastic injection moulding. Very dimensionally accurate, stable puzzle pieces are obtained in this way at reasonable manufacturing costs. Alternatively however, it is also possible, depending upon the material selected for the puzzle pieces, to use stamping methods for manufacturing them.

The invention will be explained in greater detail below, together with further advantages, with the aid of diagrammatic drawings of preferred embodiments. In the drawings.

Figure 1A:
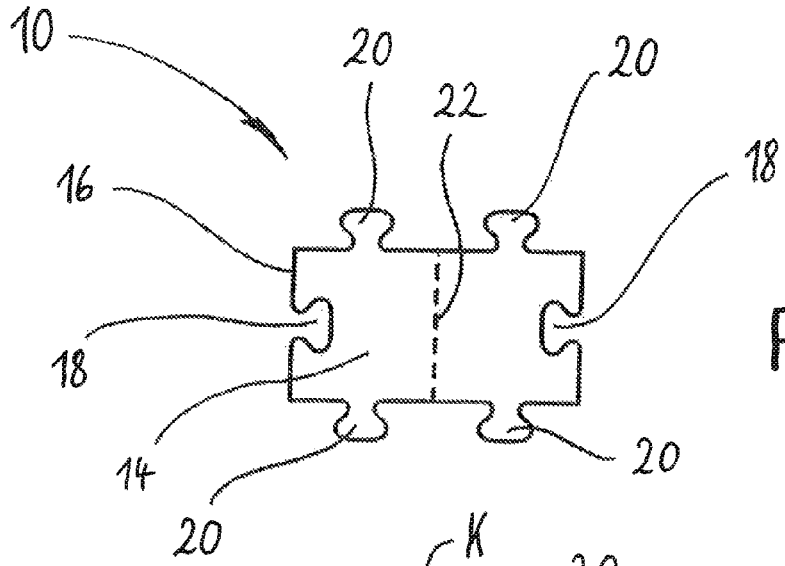
FIG. 1A shows, in plan view, a puzzle piece that can be bent along a bending line.
Figure 1B:
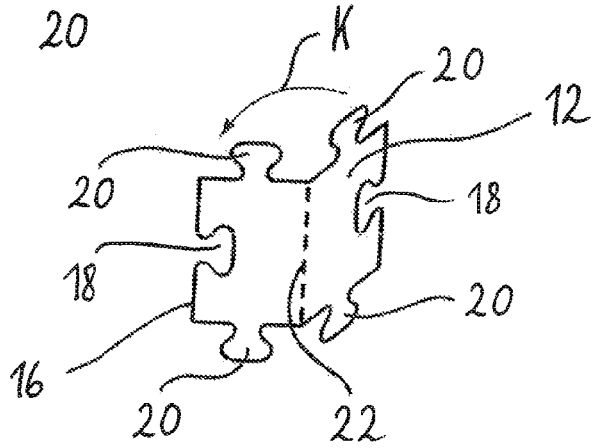
FIG. 1B shows the puzzle piece from FIG. 1A in a state in which it is already slightly bent over.

Represented in FIGS. 1A and 1B is a first embodiment of a puzzle piece, which is designated generally by 10 and which has an upper side 12, which is referred to as the "visible side", a lower side 14, which is arranged in the opposite direction, and a peripheral edge 16 which extends between the upper side 12 and the lower side 14. The extent of the peripheral edge 16 between the upper side 12 and the lower side 14 corresponds to the puzzle piece thickness. In the embodiment shown, two puzzle piece recesses 18 extend inwards, and four puzzle piece prolongations 20 outwards, from the peripheral edge 16, and these serve to connect the puzzle piece 10 to other, matching puzzle pieces (not represented) in the usual way. The puzzle piece recesses 18 and puzzle piece prolongations 20 are merely exemplary, and can be shaped and arranged in other ways.

The puzzle piece 10 can be bent over, as indicated by an arrow K (see FIG. 1B), along a bending line 22 which is reproduced in dotted form and which, in the embodiment shown, extends parallel to two edges of the puzzle piece 10.

Figure 2:
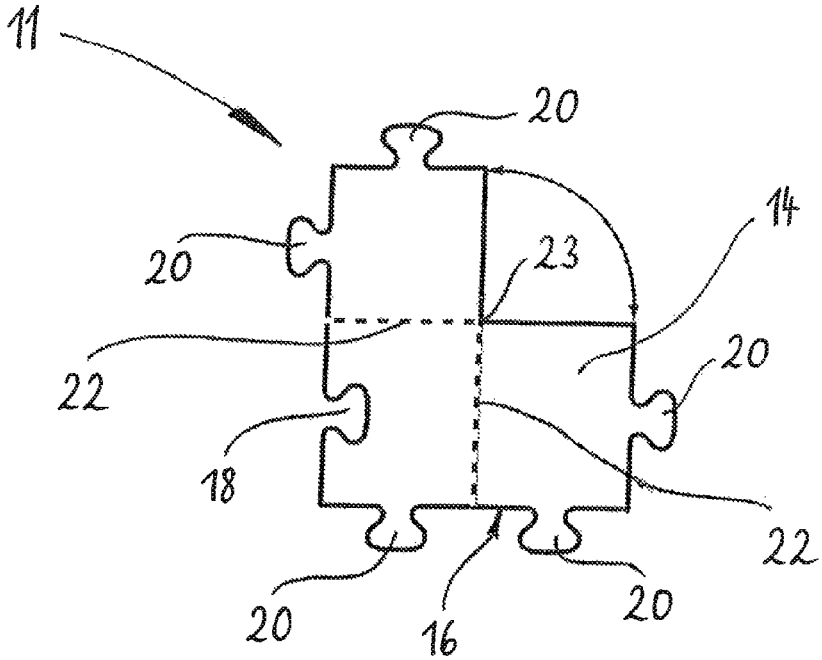
FIG. 2 shows, in plan view, a puzzle piece that can be bent along two bending lines which extend at right angles to one another.
Figure 3:
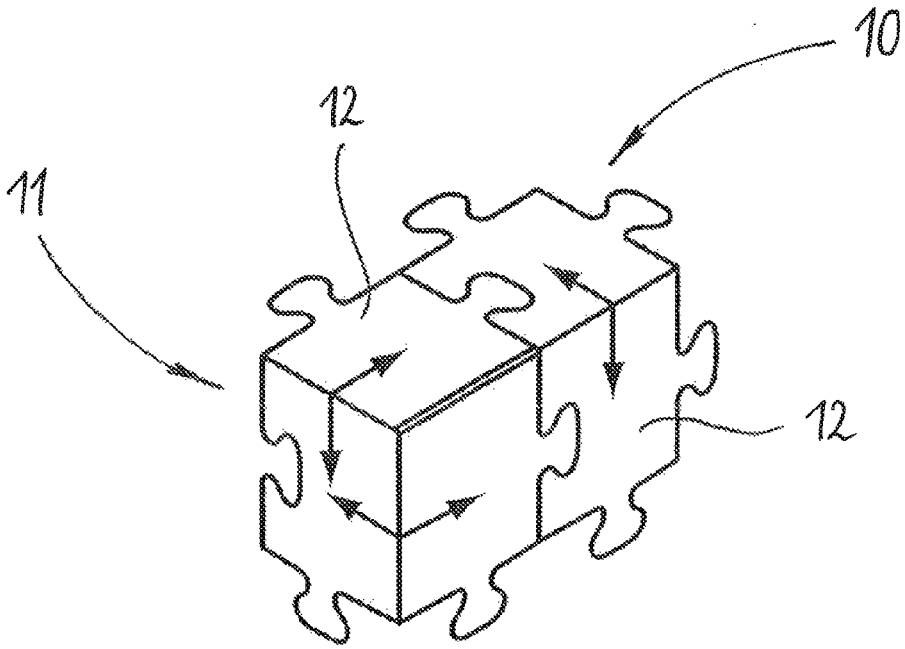
FIG. 3 shows, in a three-dimensional representation, the puzzle pieces from FIG. 1A and FIG. 2 in the state in which they are bent over and connected to one another.
Figure 4:
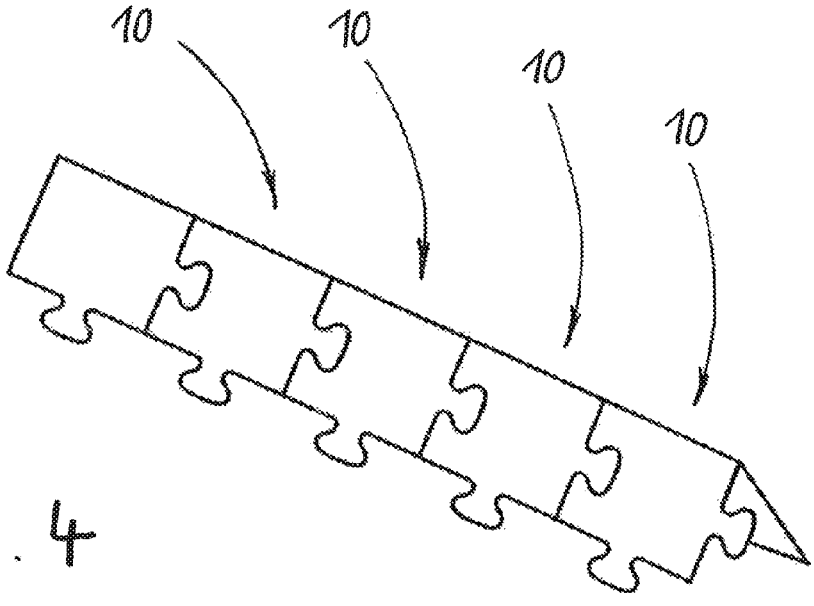
FIG. 4 shows, in a three-dimensional representation, a number of puzzle pieces in accordance with FIG. 1A which have been bent over and connected to one another and which, together, form an angle profile.

FIG. 2 shows, in plan view, a puzzle piece 11 in accordance with a second embodiment, that corresponds, in its basic composition, to the puzzle piece 10 but has two bending lines 22 which extend at right angles to one another and meet at their common end point 23. The puzzle piece 11 can be shaped, by being bent over twice along its bending lines 22 towards the same side, to form a three-dimensional body in the shape of the corner of a cube or of a parallelepiped. FIG. 3 shows the two puzzle pieces 10 and 11 in the finished state in which they have been bent over and connected to one another, in a three-dimensional representation, and illustrates the fact that the puzzle piece 11 can form the corner of, for example, a cube, the edges of which can then be continued by puzzle pieces 10. FIG. 4 shows, in a three-dimensional representation, a number of puzzle pieces 10 which have been bent over and connected to one another and which, together, form an angle profile which can serve, for example, for continuing the edge of a cube in accordance with FIG. 3.

Figure 5:
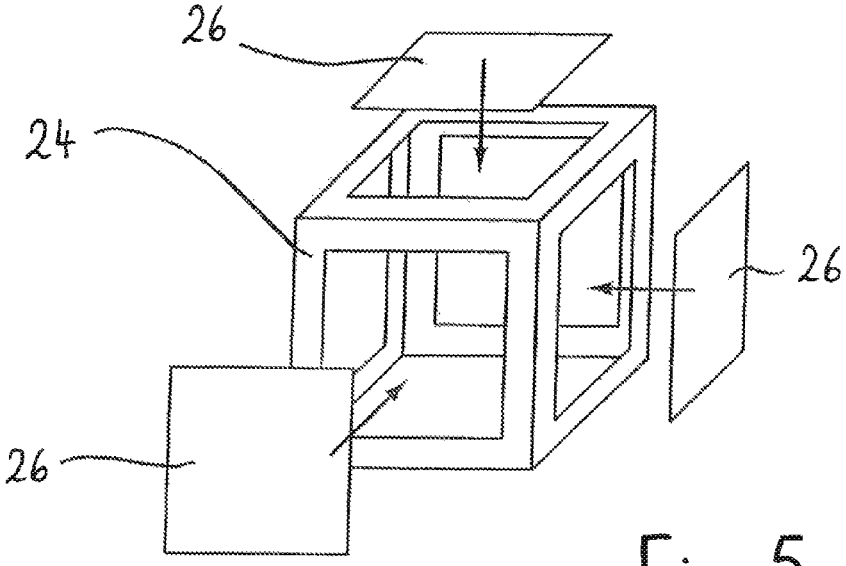
FIG. 5 shows, in a three-dimensional, diagrammatic representation, a cube made of puzzle pieces such as can be produced with the aid of the bendable puzzle pieces shown in FIGS. 1A and 2.

FIG. 5 shows, diagrammatically and in a three-dimensional view, a cube which is assembled from puzzle pieces and whose load-bearing framework 24 is built up, in accordance with FIGS. 3 and 4, from puzzle pieces 10 and 11. One face 26 which is assembled from non-bendable puzzle pieces is inserted, in each case, in this load-bearing framework 24 on all the sides of the cube. The peripheral edges 16, recesses 18 and prolongations 20 of all the puzzle pieces forming the cube are preferably of self-stabilising design, as is described in German Patent Application No. 10 2009 056 286.9 by the same Applicant.

Figure 6A:
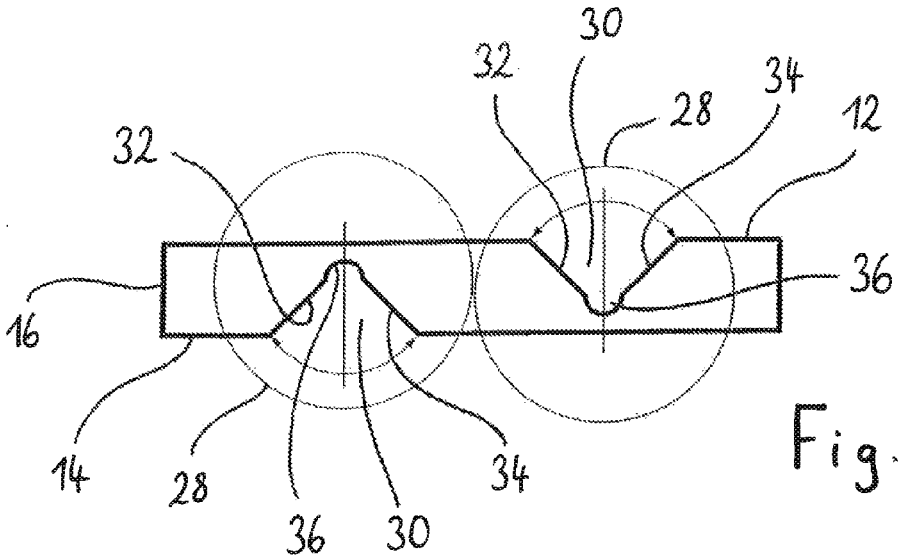
FIG. 6A shows, in section, a puzzle piece that can be bent in opposite directions and has two bending lines which extend parallel to one another.
Figure 6B:
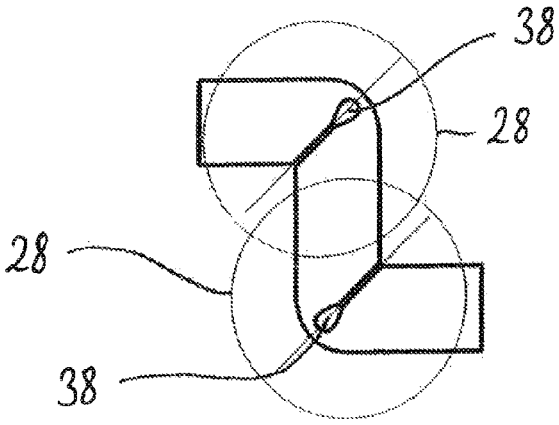
FIG. 6B shows the puzzle piece from FIG. 6A in the bent-over state.

The predefined bending lines 22 of the puzzle pieces 10, 11 and of all the other forms of embodiment are formed by a groove-like reduction in the puzzle piece thickness along each bending line 22. FIG. 6A shows, in section, a first form of embodiment of folding regions 28 in which grooves 30 formed by the reduction in thickness have a substantially V-shaped cross-section with two side walls 32, 34 that face towards one another and extend above a bottom region 36, the cross-section of which is semicircular when the puzzle piece is in the non-bent state, as represented. The point of the V-shaped cross-section of each groove 30 is cut off, so to speak, and has been replaced by a trough-shaped bottom region having, in the example shown, a semicircular cross-section. As FIG. 6B shows, the trough-shaped bottom region 36 with a rounded-off cross-section effectively prevents the material from being squeezed in the region of the base of the groove when the puzzle piece is bent over along its bending lines 22. Although the free cross-section of the space enclosed by the bottom region 36 is diminished when the bending-over operation occurs, there nevertheless continues to exist, even in the completely bent-over state, a free space 38 which helps to minimise elastic restoring forces that tend to open the folded-over puzzle piece again. In the embodiment shown, the side walls 32, 34 to serve as limiting stops, through the fact that, shortly after the desired bending angle, which is 90 degrees in this case, is exceeded, they come into contact with one another and no longer allow any ongoing bending-over.

In this way, the material of the puzzle piece is protected against becoming overstretched in the region of the bending point itself.

Figure 7A:
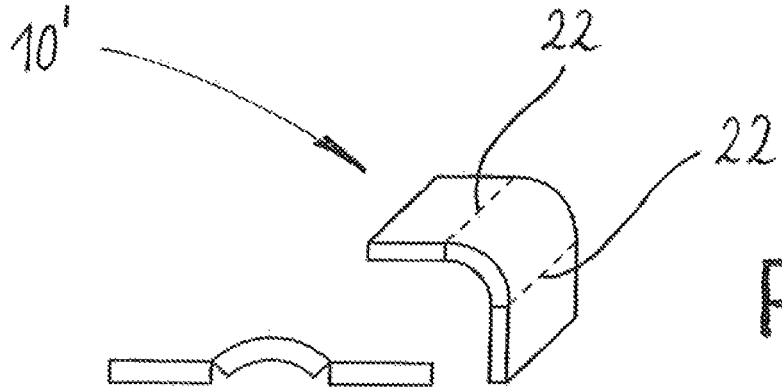
FIG. 7A shows, in cross-section and in a three-dimensional representation, a puzzle piece that can be bent twice towards the same side and has an arched section.
Figure 7B:
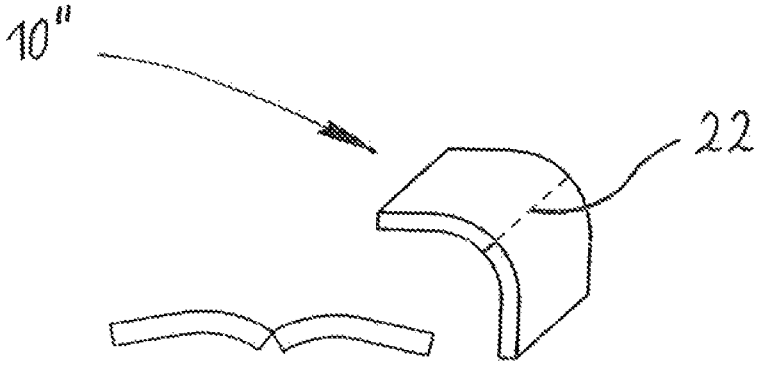
FIG. 7B shows, in cross-section and in a three-dimensional representation, a puzzle piece that can be bent once and has arched faces.
Figure 7C:
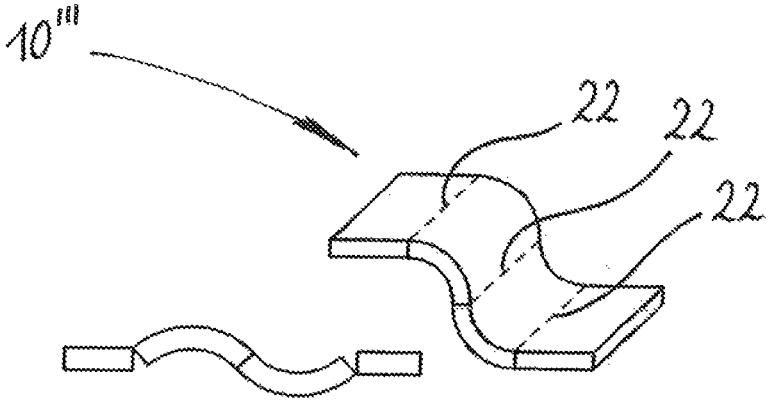
FIG. 7C shows, in section and in a three-dimensional representation, a puzzle piece that can be bent three times in opposite directions and has arched sections.

In three-dimensional views, FIGS. 7A, 7B and 7C show respectively, in the non-bent cross-section and after corresponding bending-over, various bendable puzzle pieces 10', 10", 10''', which are of arched design in part and which have one or more bending lines 22 that extend parallel to one another. The three-dimensional bodies that can be achieved by means of these puzzle pieces 10', 10" and 10''' are illustrated by the three-dimensional view in the corresponding figure, the two outer bending regions 28 in the case of FIG. 7C having inner sides of the bends that are arranged in opposite directions.

Figure 8:
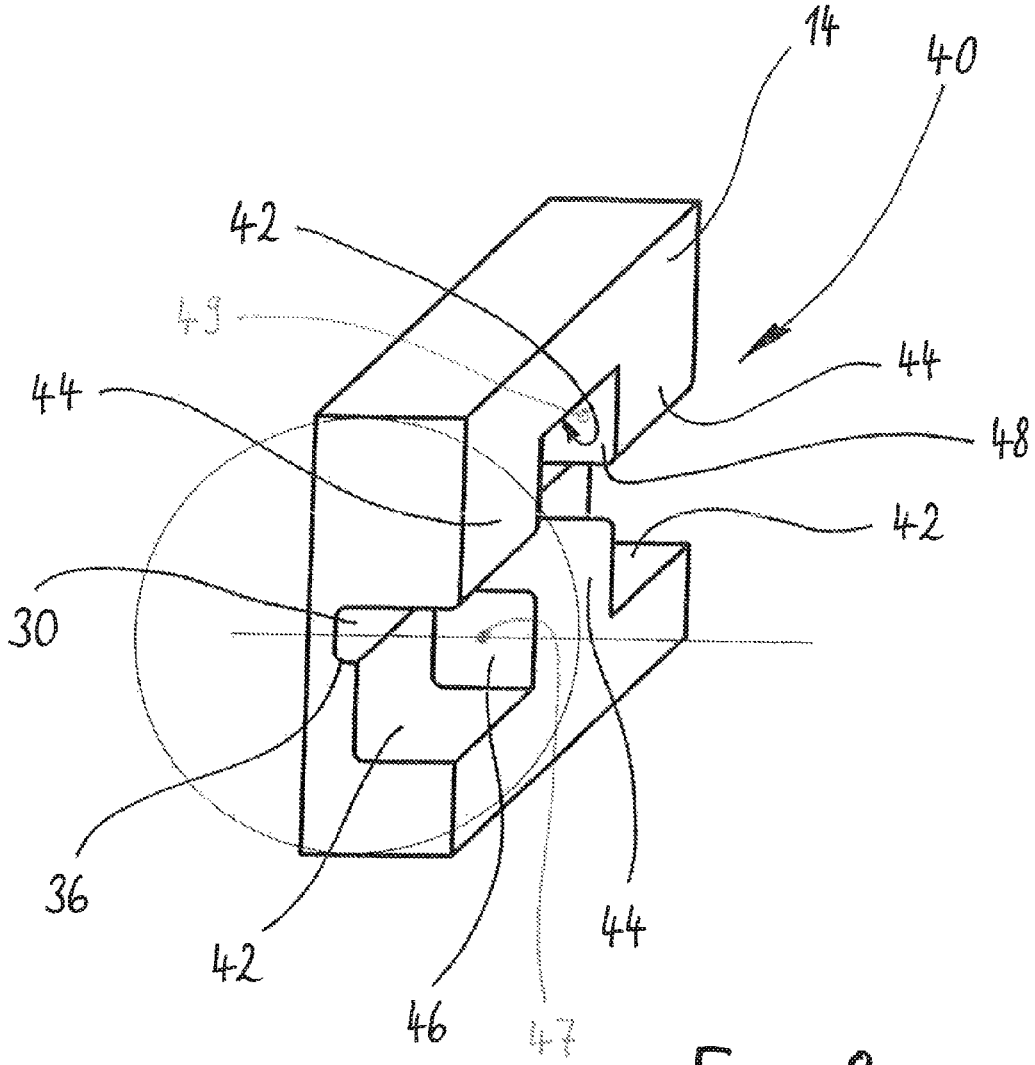
FIG. 8 shows a detail view of a fixing device for fixing a desired bending angle.
Figure 9A:
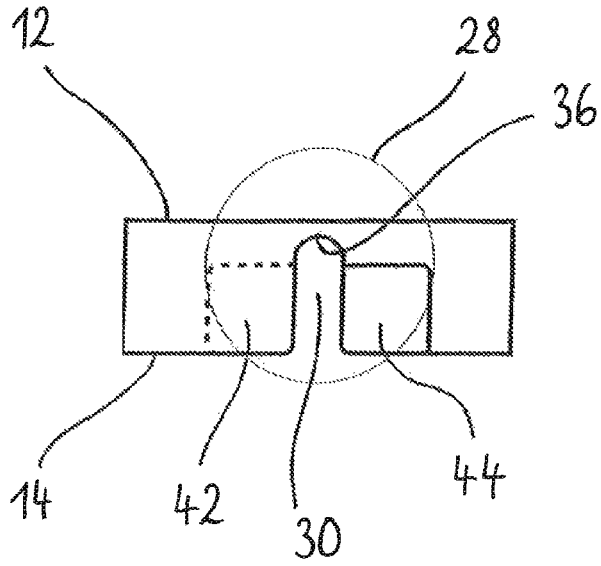
FIG. 9A shows the puzzle piece with the fixing device from FIG. 8, in cross-section and in the open state.
Figure 9B:
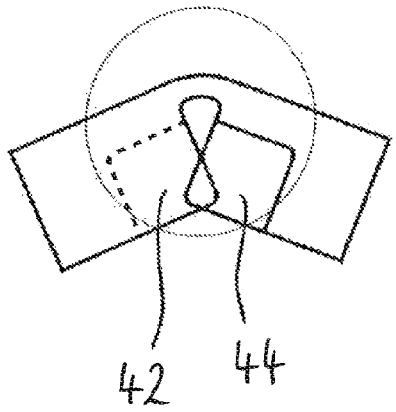
FIG. 9B shows the puzzle piece from FIG. 9A, in cross-section and in a slightly bent-over state.
Figure 9C:
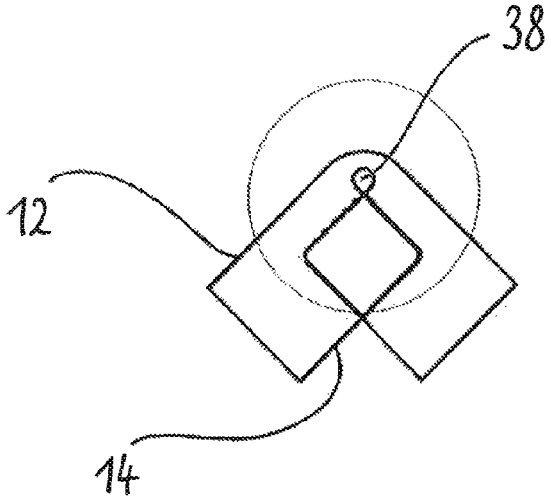
FIG. 9C shows the puzzle piece from FIG. 9A, in cross-section and in the completely bent-over state.

In order to neutralise the action of the minor restoring forces that still remain in bendable puzzle pieces 10 and 11, each puzzle piece 10, 11 has, for each bending region 28, a fixing device 40 which is able to releasably fix a desired bending angle. A first form of embodiment of one such fixing device 40 is represented in FIG. 8. The fixing device 40 has three recesses 42, of which one is constructed in the side wall 32, and two in the opposing side wall 34, of the groove 30. Those parts of the side walls 32, 34 that are devoid of recesses form corresponding protrusions 44 which engage in the associated recess 42 in each case when the puzzle piece is bent over. This is shown more precisely by FIGS. 9A, 9B and 9C, of which FIG. 9A shows the completely open state, FIG. 9B a slightly bent-over state and FIG. 9C the completely bent-over state of the puzzle piece, in section. The way in which each protrusion 44 engages in the associated recess 42 from a specific bending angle onwards, and completely fills up said recess when the desired bending angle is reached, can be clearly seen.

Each of the protrusions 44, which in this case are block-shaped, can be constructed with a slight oversize with respect to the associated recess 42, so that it enters into engagement with said recess in a clamping manner. In this connection, the clamping force is of a magnitude such that it is at least sufficient to compensate for the elastic restoring force of the bendable puzzle piece, i.e. the elastic restoring force which is still present must not be capable of automatically varying the bending angle fixed by means of the clamping force.

In addition to, and/or as an alternative to, the clamping engagement, there may be present, on faces 46 of the protrusion 44 that extend in the direction of the cross-section of the groove and/or on corresponding faces 48 of the recess 42, latching protrusions which come into engagement, in an inter-latching manner, with a corresponding latching depression in the opposing face 48 or 46, respectively, when the puzzle piece 10, 11 is in a predetermined bending position. This predetermined bending position will usually correspond to the desired bending angle. The latching engagement is designed so as to be releasable, for example through the fact that spherical-segment-shaped latching protrusions interact with cup-shaped latching depressions. By way of example, a latching protrusion 47 of this kind on the face 46 and a latching depression 49 of this kind in the face 48 are represented in FIG. 8.

Figure 10A:
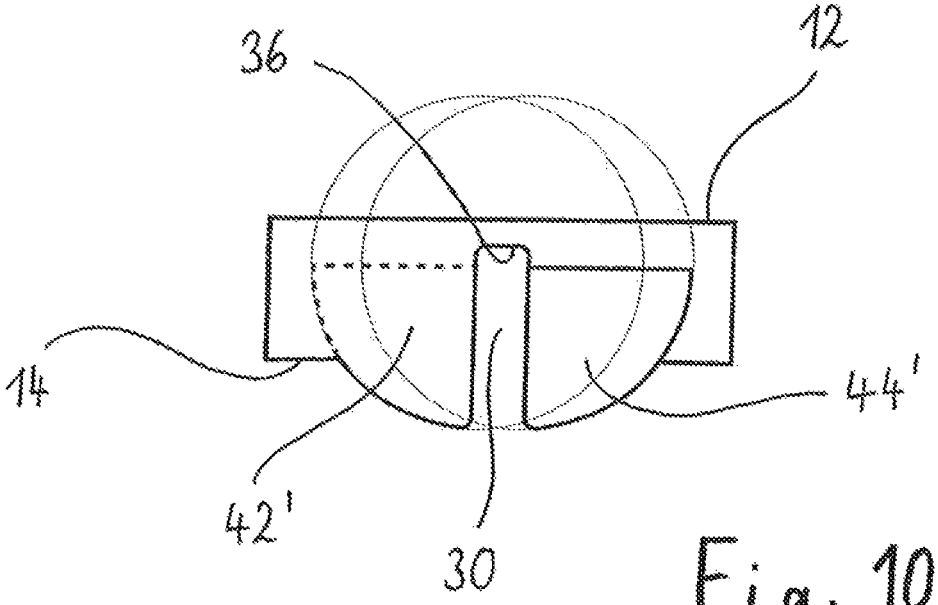
FIG. 10A shows a puzzle piece similar to FIG. 9A, in cross-section and with a modified fixing device, in the open state.
Figure 10B:
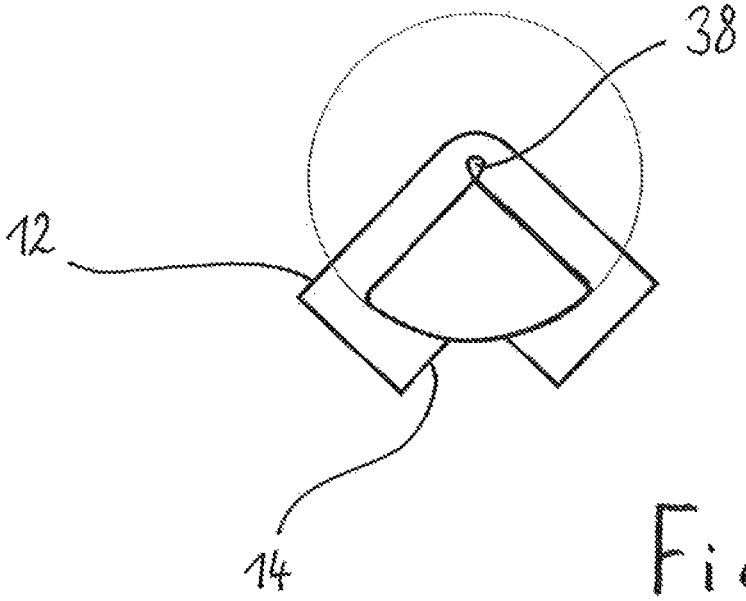
FIG. 10B shows the puzzle piece from FIG. 10A, in cross-section and in the completely bent-over state.

If, for example, the thickness of the material of a puzzle piece 10, 11 is too small to accommodate a fixing device 40 in the space available, it is possible, in accordance with FIG. 10A, for protrusions 44' to also project above the thickness of the material of the puzzle piece and to be, for example, of lamella-like design. The resulting configuration in the bent-over state after the desired bending angle has been reached is represented in FIG. 10B. The way in which the protrusions 44' and associated recesses 42' function corresponds to that of the recesses 42 and protrusions 44.

Although only one fixing device 40 in each case, per bending region 28, has been explained above, it is understood that a number of these may be arranged in a manner distributed over the length of a bending line 22. Also, the protrusions 44 do not have to be block-shaped, but may, for example, be of pin-shaped or lamella-shaped design.

What is claimed is:

1. Jigsaw puzzle comprising:

at least one puzzle piece that can be bent along at least one predefined bending line and including an upper side, a lower side and a puzzle piece thickness that extends between the upper side and the lower side, wherein the puzzle piece thickness is reduced from an inner side of the bend along the at least one predefined bending line, wherein, on either side of, and along, each bending line, is a fixing device which releasably fixes a desired bending angle, each fixing device having at least one recess in which a corresponding protrusion engages in a clamping and/or latching manner when the puzzle piece is bent; the at least one recess is provided in a side wall of a groove which is formed along each bending line by a reduced puzzle piece thickness, and the corresponding protrusion is constructed in an opposing side wall of the groove, and wherein a bottom region of the groove, above which the side walls of the groove extend, defines, when viewed in cross-section, a free space which remains at least partially maintained, even when the puzzle piece is in a bent-over state.

2. Jigsaw puzzle according to claim 1, wherein there is provided, on at least one face of the protrusion and/or one face of the recess, which face in each case extends at least substantially in the direction of the bending line cross-section, a latching protrusion which interacts, when the puzzle piece is in a predetermined bending position, in an inter-latching manner with a corresponding latching depression in an opposing face of the recess or of the protrusion respectively.

3. Jigsaw puzzle according to claim 1, wherein the protrusion is formed by a section of a particular side wall of the groove that does not project above the puzzle piece thickness.

4. Jigsaw puzzle according to claim 1, wherein the protrusion, or each protrusion, projects above the puzzle piece thickness.

5. Jigsaw puzzle according to claim 1, wherein two mutually opposing side walls of a groove each have at least one protrusion and one recess.

6. Jigsaw puzzle according to claim 1, wherein the puzzle piece has a number of bending lines which extend parallel to one another, the inner sides of which are arranged on a same side of the puzzle piece or on opposite sides of the puzzle piece.

7. Jigsaw puzzle according to claim 1, wherein the puzzle piece has two bending lines which extend at an angle to one another and have a common end point of the bending lines, the inner sides of which are arranged on a same side of the puzzle piece.

8. Jigsaw puzzle according to claim 1, wherein the side walls of the groove that face towards one another are inclined in relation to one another above the bottom region in such a way that they do not touch each other when the desired bending angle is reached.

9. Jigsaw puzzle according to claim 8, wherein the side walls of the groove are inclined in relation to one another in such a way that they come into contact with one another shortly after the desired bending angle has been exceeded.

10. Jigsaw puzzle according to claim 1, wherein, in the state in which they are folded over and connected to one another, a plurality of bendable puzzle pieces form an angle profile.

11. Jigsaw puzzle according to claim 1, wherein two mutually opposing side walls of a groove each have a number of protrusions and recesses.

* * * * *